US005284612A

United States Patent [19]

Lee

[11] Patent Number: 5,284,612

[45] Date of Patent: Feb. 8, 1994

[54] STEAM DRAW-JET PROCESS FOR MAKING PARTIALLY-ORIENTED POLYAMIDE YARNS

[75] Inventor: Lin-Fa Lee, Chattanooga, Tenn.

[73] Assignee: E. I. Du Pont de Nemours and Company, Wilmington, Del.

[21] Appl. No.: 977,687

[22] Filed: Nov. 23, 1992

[51] Int. Cl.[5] ..... B29C 47/88; D01D 5/12; D01D 10/02; D02J 1/22

[52] U.S. Cl. ..... 264/210.8; 264/211.15; 264/211.17

[58] Field of Search ..... 264/210.8, 211.14, 211.15, 264/211.17

[56] References Cited

U.S. PATENT DOCUMENTS

| | | | |
|---|---|---|---|
| 3,452,130 | 6/1969 | Pitzl | 264/555 |
| 3,452,131 | 6/1969 | Geerdes et al. | 264/210.7 |
| 4,056,652 | 11/1977 | Gauntt | 428/400 |
| 4,539,170 | 9/1985 | Hare | 264/211.15 |
| 5,082,611 | 1/1992 | Adams et al. | 264/129 |

*Primary Examiner*—Leo B. Tentoni

[57] ABSTRACT

A coupled process for making partially-oriented polyamide yarn. Polyamide polymer is melt-spun at a withdrawal speed sufficient to produce a spun yarn having an elongation less than 175%. The spun yarn is subsequently subjected to a coupled drawing step in a draw zone to reduce the elongation to the range of 50 to 100%. In the draw zone, the yarn passes through an enclosure with a gaseous fluid jet having a temperature of at least about 190° C. which impinges on the yarn in an intersecting relationship to the path of yarn travel.

8 Claims, 4 Drawing Sheets

STEAM DRAW-JET PROCESS FOR MAKING PARTIALLY-ORIENTED POLYAMIDE YARNS

BACKGROUND OF THE INVENTION

The present invention relates to processes for making partially-oriented polyamide yarns for textile applications.

Partially-oriented polyamide yarns are in widespread use as feed yarns for draw texturing and other uses. Various processes are known for manufacturing such feed yarns. In one such process, polyamide polymer is melt-spun at a withdrawal speed sufficient to produce a yarn as spun having an elongation less than 175%. In a coupled drawing step, the yarn is then drawn sufficiently to produce the partially-oriented nylon yarn with an elongation in the range of 50–100 percent. For some enduses, however, this coupled spin-draw process sometimes does not provide partially-oriented nylon yarns with a desired degree of dye uniformity.

When it is attempted to use a heated fluid jet such as that disclosed in Geerdes et al, U.S. Pat. No. 3,452,131, to localize the draw point in this process, dye uniformity is improved. However, the heated fluid jet causes loops of the filaments of the yarn to form and to extend outwardly from the yarn bundle. The filament loops decrease the quality of the yarn and make the process commercially unacceptable at spinning speeds above 2200 yards per minute (2000 meters per minute). For example, using steam at 20 pounds per square inch (138 kPa) and 135° C. with a 1.5× draw ratio, filament loops as high as 80 loops/million-end-yards (yards of yarn multiplied by number of threadlines tested) (88 loops/-million-end-meters) were observed. The problem increases with higher steam pressures and/or when higher relative viscosity polymer is used.

SUMMARY OF THE INVENTION

The invention provides a coupled process for making partially-oriented polyamide yarn. Polyamide polymer is melt-spun at a withdrawal speed sufficient to produce a spun yarn having an elongation less than 175%. The spun yarn is subsequently subjected to a coupled drawing step in a draw zone to reduce the elongation to the range of 50 to 100%. It has been discovered that dye uniformity is improved, while at the same time avoiding undesirable levels of filament loops, by passing the yarn in the draw zone through an enclosure with a gaseous fluid jet having a temperature of at least about 190° C. which impinges on the yarn in an intersecting relationship to the path of yarn travel through the enclosure.

In accordance with a preferred form of the invention, the temperature of the gaseous fluid jet is at least about 220° C. Preferably, the gaseous fluid jet is a steam jet with the steam being supplied at a pressure of about 10 to about 90 psi (69 to 620 kPa), most preferably, at a pressure of about 20 to about 60 psi (138 to 413 kPa).

In accordance with a preferred embodiment of the invention, the polyamide polymer has a relative viscosity of about 35 and to about 80 and most preferably comprises at least about 85% poly(hexamethylene adipamide) units. The withdrawal speed in a preferred process is at least about 2000 m/min.

DETAILED DESCRIPTION

Polyamide polymer as used in this application refers to any of the various generally linear, predominantly aliphatic polycarbonamide homopolymers and copolymers which are typically melt-spinnable to yield fibers having properties suitable for textile applications. Preferred polyamide polymers comprise at least about 85% poly(hexamethylene adipamide) (nylon 66) units. The polyamide polymers preferably have a relative viscosity (RV) when spun of between about 35 and about 80.

Figure 1:
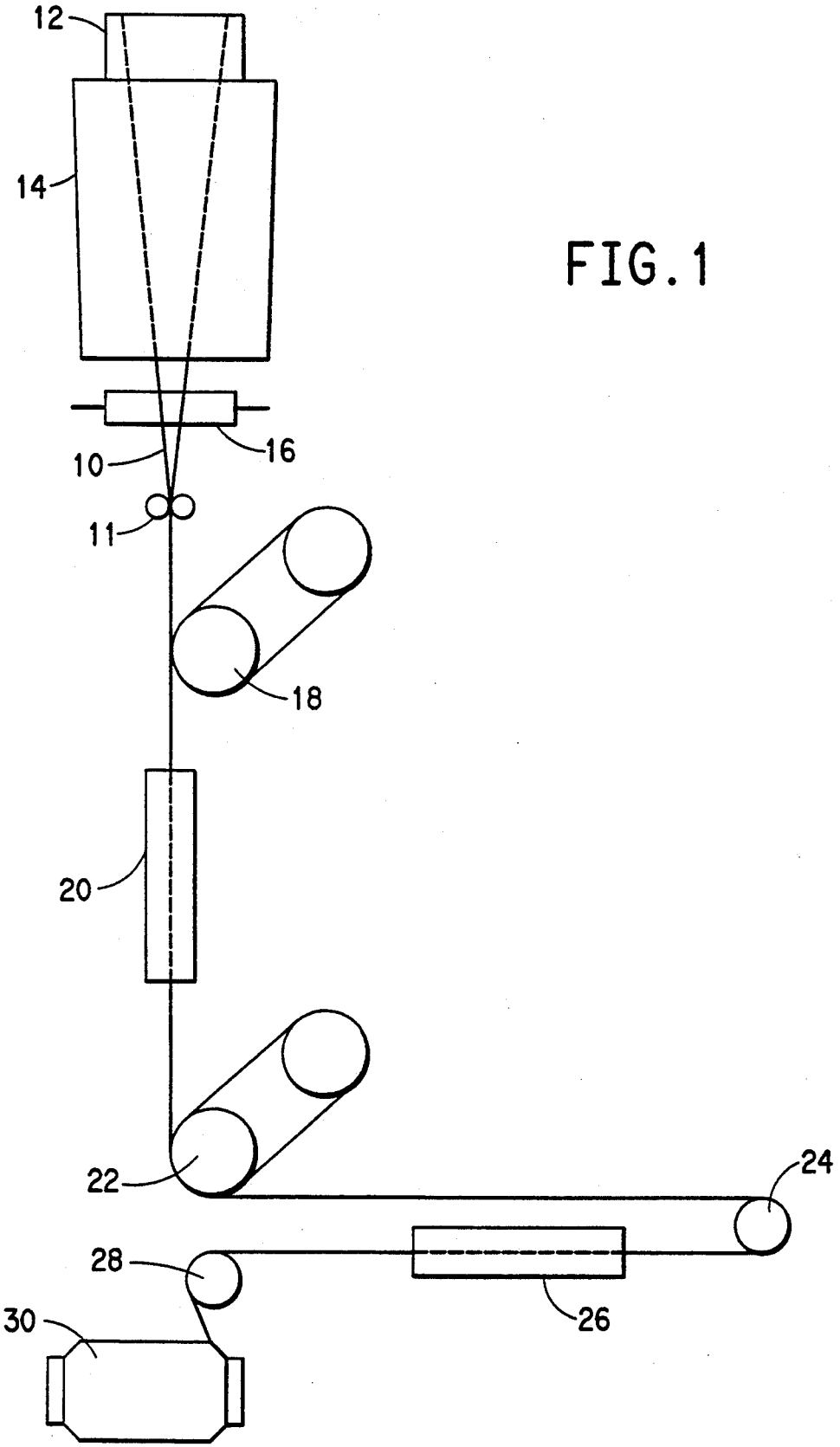
FIG. 1 is a schematic representation of a process in accordance with the invention.

Referring now to FIG. 1, a schematic representation of a process in accordance with the invention is shown. Polyamide filaments 10 are spun from a polyamide melt through spinneret 12 and solidified in a quench chimney 14. A lubricating spin finish is applied to the solidified filaments by roll applicator 16 and the filaments are converged by pins 11 into a spun yarn. The withdrawal speed, i.e., the speed at which the spun yarn is withdrawn from the spinneret (usually the same as the feed roll speed), is sufficient to impart orientation in the spun yarn so that its elongation is less than 175%. Preferably, the withdrawal speed is at least about 2000 m/min.

The spun yarn is subjected to a drawing step as it is advanced into a draw zone between feed rolls 18 and draw rolls 22. The draw rolls 22 have a higher peripheral speed than that of the feed rolls 18 and thereby determine the draw ratio in the draw zone. For the resulting partially-oriented yarns to have an elongation of about 50 to 100%, preferably 65 to 75%, the draw ratio generally should not greatly exceed 1.5× at spinning speeds above 2000 m/min to provide good package formation. A draw ratio of approximately 1.35× has been found to be especially suitable.

Between the rolls 18 and 22, an enclosure 20 is provided which contains a gaseous fluid jet in which the gaseous fluid has a temperature of at least about 190° C. The enclosure 20 is of the type disclosed in Geerdes et al, U.S. Pat. No. 3,452,131, in which the gaseous fluid jet impinges on the yarn in an intersecting relationship to the path of yarn travel through the enclosure. It has been found that the jet at a temperature of at least 190° C. reduces the number of filament loops and essentially eliminates the loops in processes of this type except in the higher RV ranges and/or when higher jet pressures are used. In a preferred form of the invention, the temperature of the gaseous fluid jet is at least about 220° C. Although the use of higher relative viscosity polymer and/or higher pressures cause the number of filament loops to be higher at lower jet temperatures, jet temperatures of at least about 220° C. essentially eliminate the formation of filament loops in the range of relative viscosities normally used to make textile yarns and in the range of pressures tested. While dye uniformity is increased in all cases, it has also been observed that the jet conditions which lead to the greatest decrease in filament loops also lead to the greatest improvement in dye uniformity. Preferably, the gaseous fluid jet is a steam jet with the steam being supplied at a pressure of about 10 to about 90 psi (69 to 620 kPa), most preferably, at a pressure of about 20 to about 60 psi (138 to 413 kPa).

From roll 22, the yarn advances to puller roll 24, is interlaced at an interlace jet 26, passes a tension let down roll 28 and advances to a wind-up 30 where the yarn is packaged.

TEST METHODS

Relative Viscosity of the polyamide refers to the ratio of solution and solvent viscosities measured at 25° C. in a solution of 8.4% by weight polyamide polymer in a solvent of formic acid containing 10% by weight of water.

Tenacity and Break Elongation are measured as described by Li in U.S. Pat. No. 4,521,484 at column 2, line 61 to column 3, line 6.

Filament Loop Analysis: Filament loops are determined in the following manner. The yarns are passed through a cleaner guide with a 3 mil (0.08 mm) clearance. When the yarn is stopped by the guide, the yarn at the cleaner guide is examined visually to determine the cause of the stop, i.e., whether it is caused by a filament loop, a nub, or a strip-back. The stops caused by filament loops are recorded for approximately 500,000 yards (457,200 meters) of each yarn sample and the recorded result is normalized to loops/million-end-yards.

Along-End Dye Uniformity: Test yarns are draw textured using a texturing machine manufactured by Barmag AG, Remscheid, Germany. The textured yarns are knitted into Lawson tubes which are dyed with Anthraquinone Milling Blue BL dye (C.I. Acid Blue 122). Dye uniformity of the knitted tubes is determined visually using a ranking of 1 to 10 with 10 being the best.

EXAMPLE 1

95 denier nylon 66 (polyhexamethyleneadipamide) partially-oriented yarns are manufactured using a process as illustrated in FIG. 1. Nylon 66 polymer flake with a relative viscosity of 41 is melted in a screw extruder and extruded through a spinneret 12 having 68 orifices with a diameter of 0.012 inch (0.3 mm). The extruded filaments are quenched in air at ambient temperature flowing at 90 cubic feet per minute (42.5 liter/sec). Finish is applied, the filaments are converged, and the quenched filaments are advanced onto feed rolls 18 rotating at a speed to provide a linear yarn velocity of 2652 ypm (2425 m/min) (withdrawal speed). From the feed rolls, the yarn advances to draw rolls 22 at 3580 ypm (3575 m/min) providing a draw ratio of ~1.35×.

Figure 2:
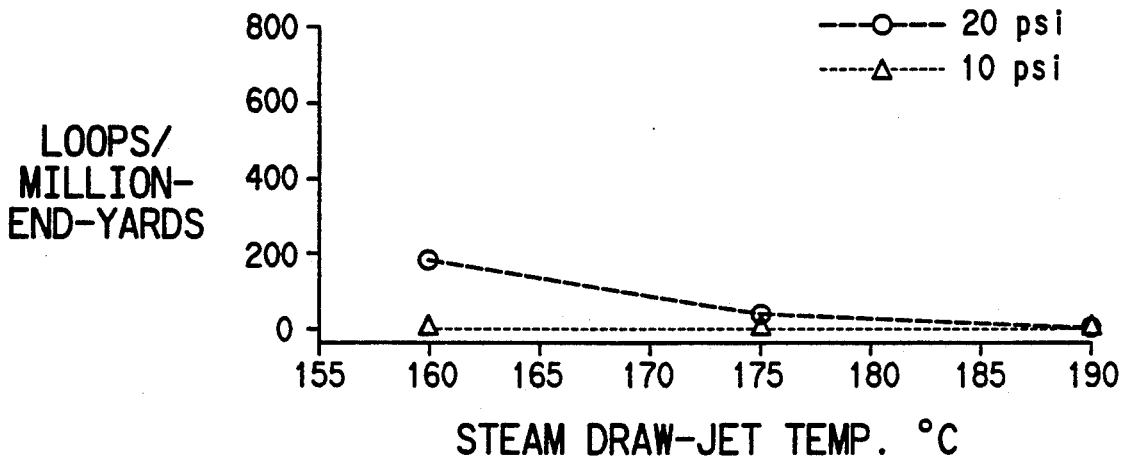
FIG. 2 is a graph of loops/million-end-yards for the yarns of Example 1.

Between the feed and draw rolls, the yarn enters an enclosure containing a jet similar in design to the chamber shown in Geerdes, U.S. Pat. No. 3,452,131. Steam at varied temperatures and pressures over the ranges indicated in FIG. 2 are supplied to the jet and the yarn impinges the jet in an intersecting relationship to the path of yarn travel. From the draw rolls 22, the yarn is pulled by roll 24 which is operated at a peripheral speed of 3573 ypm (3267 m/min). Finally, the yarn passes through an interlace jet 26 over a let-down roll 28 to the windup 30 at 3560 ypm (3255 m/min).

Although different temperature and pressures for the steam in the jet are used as indicated in FIG. 2, the resulting partially-oriented 95 denier nylon 66 yarns have the following properties:

RV: 45
Tenacity: 3.6 g/d
Break Elongation: 75%

The number of filament loops in the resulting yarns varied with steam temperature and pressure. The loops/million-end-yards of the yarns at the two steam pressures is plotted against yarn draw jet temperature in FIG. 2.

EXAMPLE 2

Figure 3:
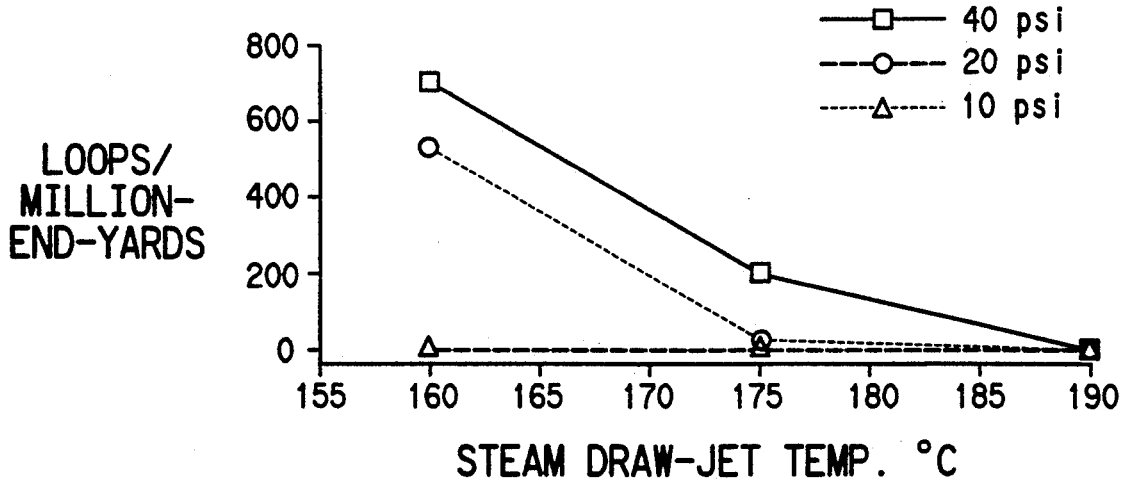
FIG. 3 is a graph of loops/million-end-yards for the yarns of Example 2.

A process as described in Example 1 is used to make 95 denier nylon 66 partially-oriented yarn except that the feed rolls 18 are operated at a slower speed so that the draw ratio is ~1.5×. Steam at varied temperatures and pressures over the ranges indicated in FIG. 3 are supplied to the jet. The resulting partially-oriented 95 denier nylon 66 yarns have the following properties:

RV: 45
Tenacity: 3.7 g/d
Break Elongation: 70%

The loops/million-end-yards of the yarns at the three steam pressures is plotted against yarn draw jet temperature in FIG. 3.

EXAMPLE 3

Figure 4:
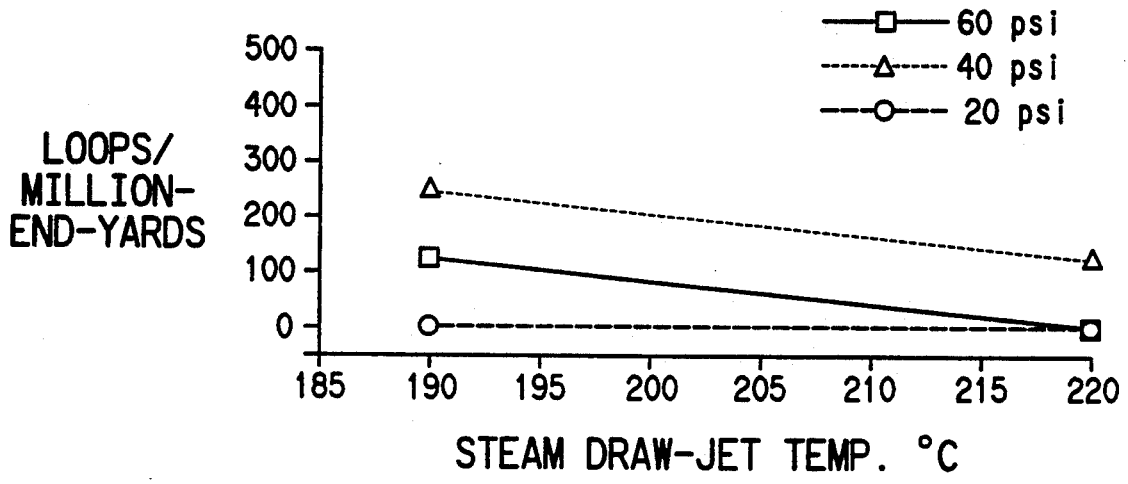
FIGS. 4 and 5 are graph of loops/million-end-yards for the yarns of Example 3.
Figure 5:
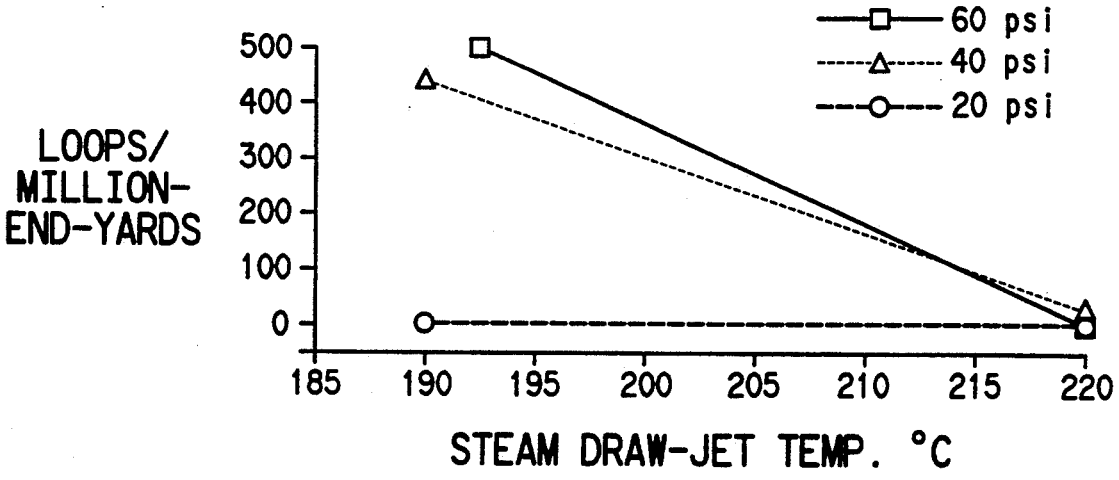

A process as described in Example 1 is used to make 95 denier nylon 66 partially-oriented yarn except that two relative viscosities 45 and 50 are used with steam supplied to the jet at varied temperatures and pressures over the ranges indicated in FIGS. 4 and 5. Tenacity and elongation of the resulting yarns are essentially the same as in Example 1. For each relative viscosity, the loops/million-end-yards of the yarns at the three steam pressures is plotted against yarn draw jet temperature in FIG. 4 and 5.

EXAMPLE 4

Figure 6:
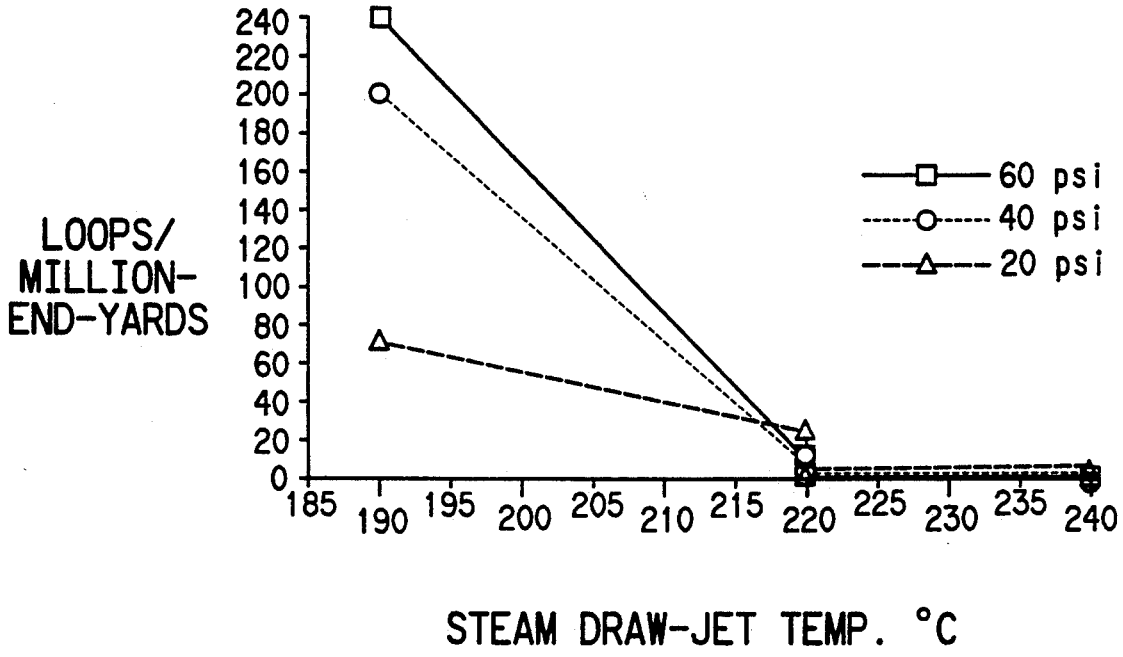
FIG. 6 is graph of loops/million-end-yards for the yarns of Example 4.

The same process as in Example 1 is used to make nylon 66 partially-oriented yarns except that steam temperatures and pressures are varied over a higher temperature range (up to 240° C.) and a control is run with no steam jet used as indicated in Table 1. Tenacity and elongation of the resulting yarns are essentially the same as in Example 1. The loops/million-end-yards of the yarns at the three steam pressures is plotted against yarn draw jet temperature in FIG. 6.

Along end dye uniformity is also measured on the yarns and the control and the results are reported in Table 1.

TABLE 1

| | Steam Jet Conditions | | |
|---|---|---|---|
| Yarn Sample | Steam Pressure psi (kPa) | Steam Temp. °C. | Dye Uniformity Ranking |
| 1 | (steam draw-jet not used) | | 3–4 |
| 2 | 20 (138) | 220 | 7 |
| 3 | 40 (276) | 240 | 9 |
| 4 | 60 (413) | 240 | 10 |

I claim:

1. In a coupled process for making partially-oriented polyamide yarn by melt-spinning polyamide polymer at a withdrawal speed sufficient to produce a spun yarn having an elongation less than 175% and subsequently subjecting said spun yarn to a drawing step in a draw zone to reduce the elongation to the range of 50 to 100% to form said partially-oriented polyamide yarn, the improvement which comprises:

passing said yarn in said draw zone through an enclosure and impinging a gaseous fluid jet on said yarn in said enclosure in an intersecting relationship to the path of yarn travel through said enclosure, said gaseous fluid having a temperature of at least about 190° C.

2. The process of claim 1 wherein said temperature of said gaseous fluid jet is at least about 220° C.

3. The process of claim 1 wherein said gaseous fluid jet is a steam jet.

4. The process of claim 3 wherein said steam supplied to said jet has a pressure of about 10 to about 90 psi.

5. The process of claim 3 wherein said steam supplied to said jet has a pressure of about 20 to about 60 psi.

6. The process of claim 1 wherein polyamide polymer has a relative viscosity of about 35 and to about 80.

7. The process of claim 1 wherein polyamide polymer comprises at least about 85% poly(hexamethylene adipamide) units.

8. The process of claim 1 wherein said withdrawal speed is at least about 2000 m/min.

* * * * *